US006463662B1

(12) United States Patent
Coscia et al.

(10) Patent No.: US 6,463,662 B1
(45) Date of Patent: Oct. 15, 2002

(54) SPOON AND STRAW COMBINATION DEVICE

(76) Inventors: Robert Coscia, 203-11 35$^{th}$ Ave., Bayside, NY (US) 11361; Michael Demarino, 990 KnightBridge Rd., Apt. 1D, Great Neck, NY (US) 11021

( * ) Notice: Subject to any disclaimer, the term of this patent is extended or adjusted under 35 U.S.C. 154(b) by 0 days.

(21) Appl. No.: 09/829,349

(22) Filed: Apr. 9, 2001

(51) Int. Cl.$^{7}$ ..... A47J 43/28
(52) U.S. Cl. ..... 30/141; 30/324; D7/300.2
(58) Field of Search ..... 30/141, 142, 324; D7/643, 644, 300.2

(56) References Cited

U.S. PATENT DOCUMENTS

| | | | | | |
|---|---|---|---|---|---|
| 674,446 | A | | 5/1901 | Marx | 30/141 |
| 1,490,785 | A | | 4/1924 | Purnell | 30/141 |
| 1,857,712 | A | | 5/1932 | De Martini, Jr. | 30/141 |
| 2,184,857 | A | | 12/1939 | Dorozinski | 30/141 |
| 2,334,535 | A | | 11/1943 | Bandell | 30/141 |
| 2,859,515 | A | | 11/1958 | Kinham | 30/141 |
| D259,533 | S | | 6/1981 | Frodsham | D7/42 |
| 5,038,476 | A | * | 8/1991 | McCrea | 30/141 |
| D330,481 | S | * | 10/1992 | Green | D7/300.2 |
| D370,587 | S | * | 6/1996 | Lynch | D7/300.2 |
| 5,727,321 | A | * | 3/1998 | Lewis | 30/141 |
| D414,382 | S | | 9/1999 | Crane et al. | D7/643 |
| 5,946,807 | A | * | 9/1999 | Crane et al. | 30/141 |
| D440,810 | S | * | 4/2001 | Olson | D7/300.2 |

* cited by examiner

*Primary Examiner*—Hwei-Siu Payer
(74) *Attorney, Agent, or Firm*—Collard & Roe, P.C.

(57) ABSTRACT

A spoon and straw combination device comprising a substantially hollow handle having at least one opening, and a scoop attached to the substantially hollow handle. The scoop has a top face shaped similar to a spoon and at least one hole. There is also a reservoir disposed below the top face on the scoop. This reservoir is in fluid communication with the top face and the substantially hollow handle so that when the scoop is placed inside a fluid this fluid can be drawn through the hole, into the reservoir and through the substantially hollow handle. This reservoir is shaped non cylindrical. In this case, the reservoir is bounded by a top plate shaped as a spoon and a bottom plate also shaped as a spoon. Both the top and bottom plates are coupled together forming the hole.

10 Claims, 3 Drawing Sheets

SPOON AND STRAW COMBINATION DEVICE

BACKGROUND OF THE INVENTION

Field of the Invention

The invention relates to a spoon-straw combination. More particularly the invention relates to a spoon-straw combination that is molded as a one-piece instrument.

SUMMARY OF THE INVENTION

A spoon and straw combination device comprising a substantially hollow handle having at least one opening, and a scoop attached to the substantially hollow handle. The scoop has a top face shaped similar to a spoon and at least one hole. There is also a reservoir disposed below the top face on the scoop. This reservoir is in fluid communication with the top face and the substantially hollow handle so that when the scoop is placed inside a fluid this fluid can be drawn through the hole, into the reservoir and through said substantially hollow handle. This reservoir is shaped non cylindrical. In this case, the reservoir is bounded by a top plate shaped as a spoon and a bottom plate also shaped as a spoon. Both the top and bottom plates are coupled together forming the hole.

The hole could either have a circular or non circular opening. This hole could also be placed at an end of the spoon opposite the spoon's connection to the hollow handle or positioned in the spoon adjacent to the hollow handle.

This hole could also be crescent moon shaped which is formed by a connection between the top plate and the bottom plate of the reservoir.

BRIEF DESCRIPTION OF THE DRAWINGS

Other objects and features of the present invention will become apparent from the following detailed description considered in connection with the accompanying drawings which disclose several embodiments of the present invention. It should be understood, however, that the drawings are designed for the purpose of illustration only and not as a definition of the limits of the invention.

In the drawings wherein similar reference characters denote similar elements throughout the several views.

DETAILED DESCRIPTION OF THE PREFERRED EMBODIMENTS

Figures 1, 2:
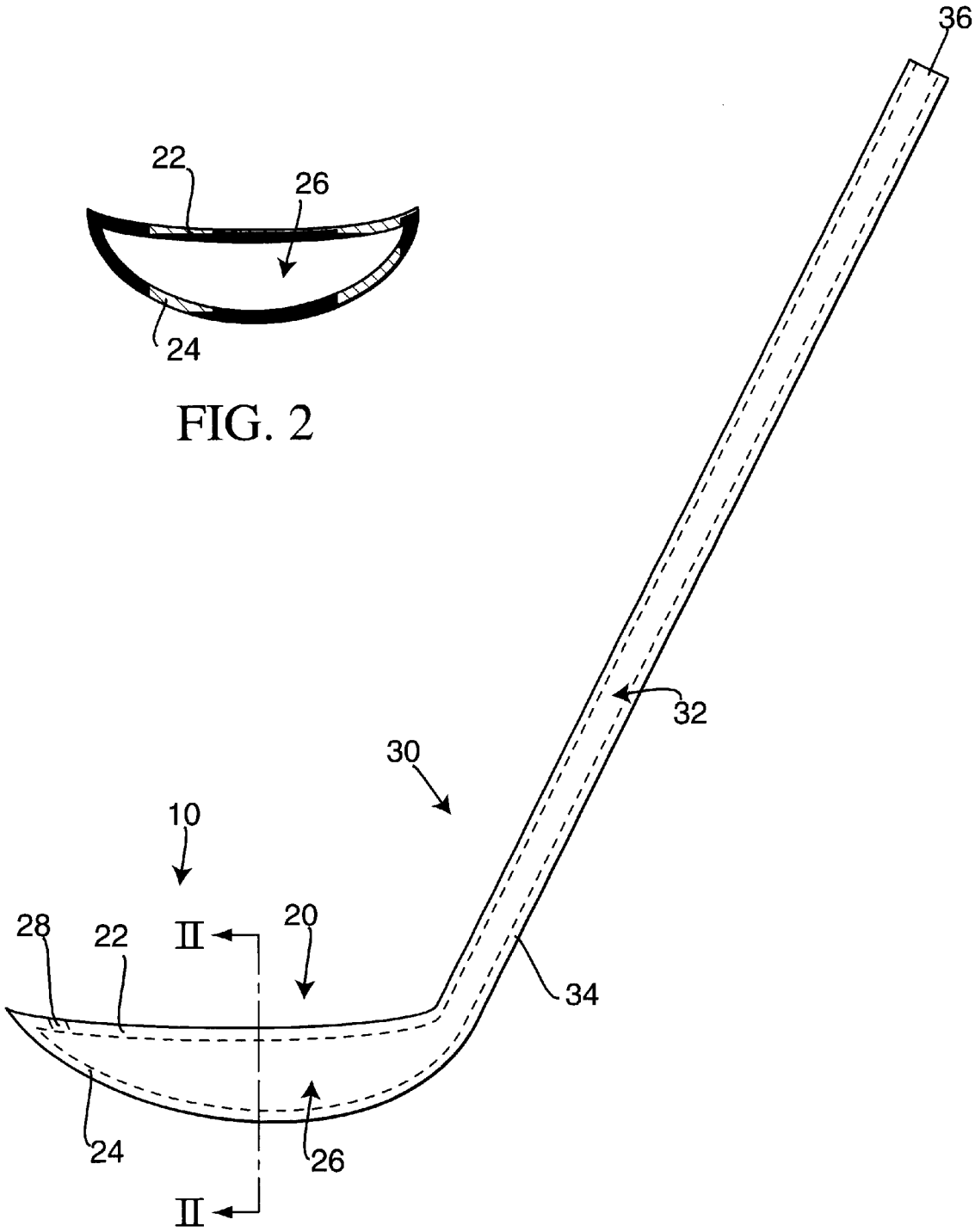
FIG. 1 is cross-sectional view of the first embodiment of the invention.
FIG. 2 is a front cross sectional view of the first embodiment of the invention taken along the line II—II.

Referring to the drawings, FIG. 1 is a cross sectional view of a spoon straw combination device 10 comprising a scoop portion 20 and a hollow handle portion 30. Scoop portion 20 comprises a top plate 22 and a bottom plate 24 forming a reservoir 26. On top plate 22 is a hole 28 which is in fluid communication with reservoir 26.

Hollow handle 30 extends up from scoop portion 20 and includes a hollow chamber 32 and a shell 34 that extends up from hollow chamber 32. On a top portion of chamber 32 is a hole 36 which allows a user to draw fluid out of chamber 32 and into the user's mouth.

FIG. 2 shows a cross-sectional view of reservoir 26 which includes bottom plate 24 and top plate 22. Reservoir 26 is designed to have a sufficient size to easily receive a viscous fluid such as a milk shake or a frosty drink. This reservoir has a non-circular cross section that is shaped similar to a crescent. With this design, a user can draw fluid into reservoir 26, such that this fluid remains in reservoir 26 as a reserve supply before being drawn into chamber 32 in hollow handle 30.

Figure 3:
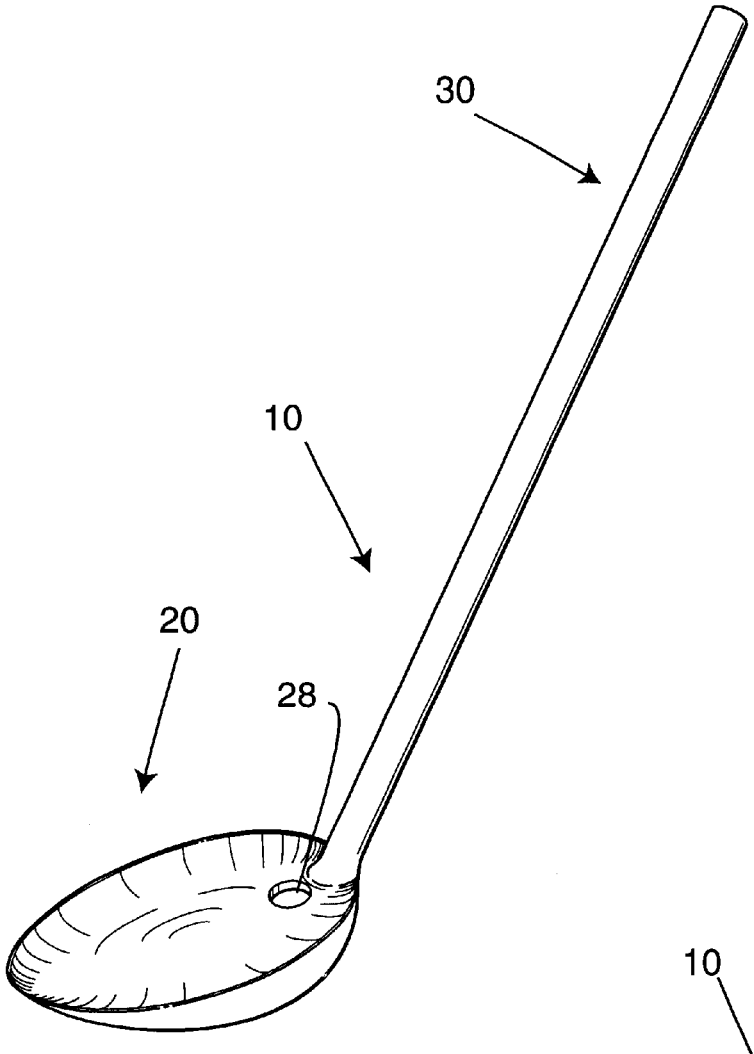
FIG. 3 perspective view of the first embodiment of the invention.

FIG. 3 shows a perspective view of the first embodiment of the invention 10, wherein hole 28 is placed at an end of scoop 20 in a region opposite from where hollow handle 30 connects to scoop 20. With this design, a user would position this device 10 substantially vertically and place inside a glass or cup, submerged underneath the fluid. The user would then draw fluid into reservoir 26, through hole 28. This fluid would then fill reservoir 26. Next, the fluid would then flow up through hollow handle 30 through chamber 32 and out of hole 36.

Figure 4:
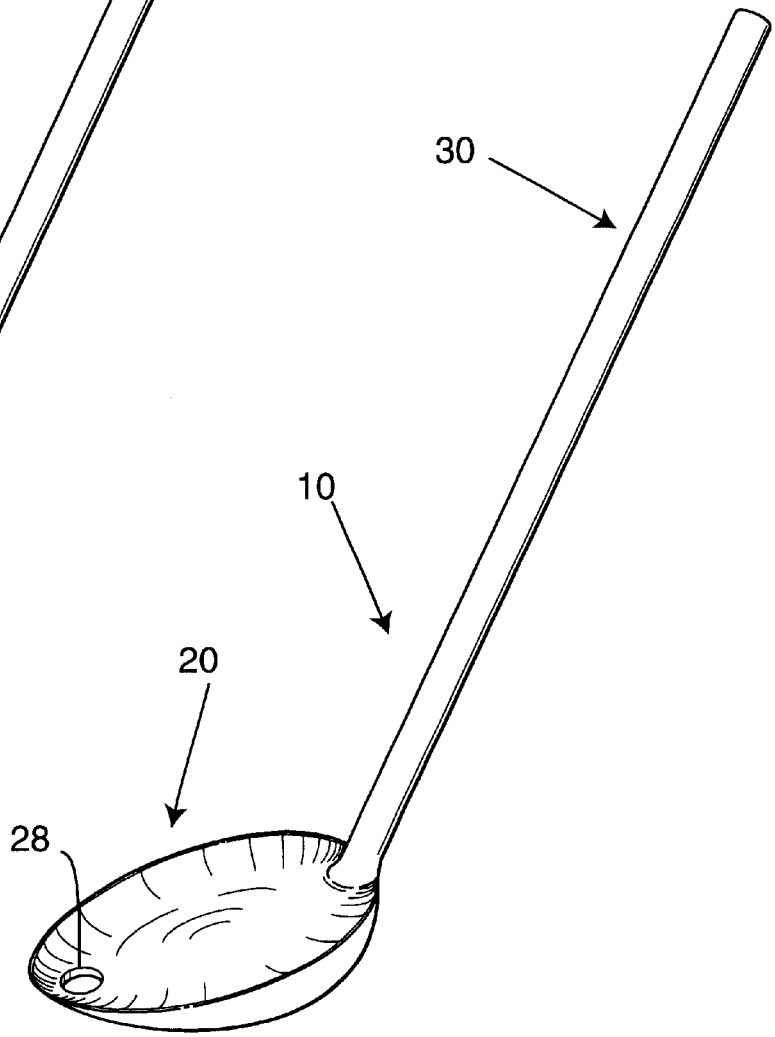
FIG. 4 is a perspective view of the second embodiment of the invention.

FIG. 4 shows the second embodiment of the invention. With this design, hole 28 is positioned in scoop 20 adjacent to hollow handle 30. A user could position this device 10 substantially vertically, inside a cup or glass and then draw fluid through hole 28 through only a top portion of reservoir 26 and then up through hollow handle 30.

Figure 5:
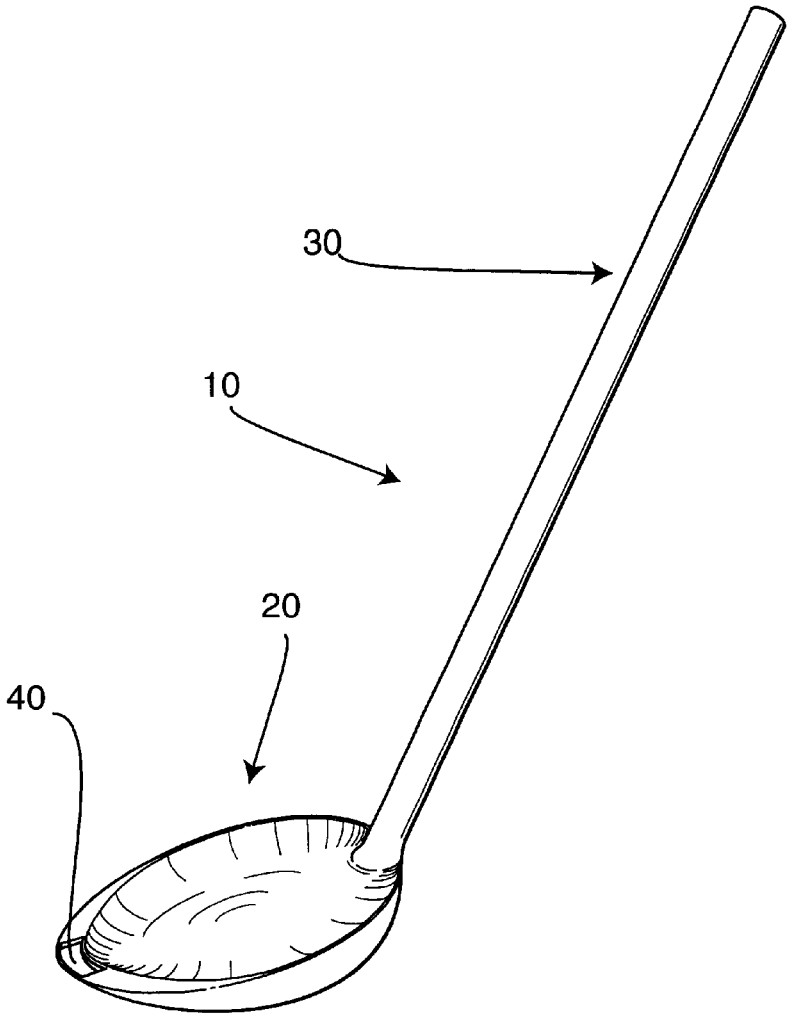
FIG. 5 is a perspective view of the third embodiment of the invention.
Figure 6:
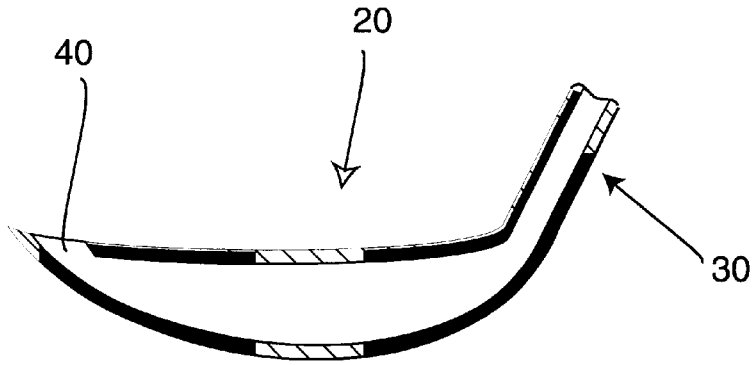
FIG. 6 a cross-sectional view of the third embodiment of the invention.

FIG. 5 shows a third embodiment of the invention wherein there is a hole 40 positioned on an end of scoop 20. Hole 40 has a non-circular cross-section and is formed by a gap or offset between top plate 22 and bottom plate 24 (See FIG. 2). This non-circular cross section allows fluid to easily flow into reservoir 26, because it is formed wider than holes 28 having a circular cross section. This additional width of hole 40 allows hole 40 to accommodate any possible impingements such as chunks of ice, ice cream, or any other gel-like substance that would be inside a viscous drink such as a milk shake.

This design is also beneficial because it allows a hole to be formed simply by applying top plate 22 to bottom plate 24 in an offset manner while sealing the sides of these plates 22 and 24 together to leave a gap or hole 40. Thus, during manufacturing, scoop 20 can be formed by two separate plates joined together around a substantial portion of a rim joining these two plates together.

In all of these designs, holes 28 and 40 have a smaller cross section than that of reservoir 26 or that of chamber 32 in hollow handle 30. Thus, any large chunk of ice will not go through holes 28 and 40 and then get stuck inside of reservoir 26 or chamber 32. In addition, reservoir 26 is designed to allow viscous fluid such as a shake to expand and fill reservoir 26 to create an even supply for a user. This expanded region inside of reservoir 26 allows this fluid to break apart and become more fluid like to allow a user to easily draw this fluid up through chamber 32.

Accordingly, while several embodiments of the present invention have been shown and described, it is to be understood that many changes and modifications may be made thereunto without departing from the spirit and scope of the invention as defined in the appended claims.

What is claimed is:

1. A dining utensil device comprising:

a substantially hollow handle having at least one opening;

a scoop attached to said substantially hollow handle, said scoop having a substantially spoon shaped top face and at least one hole; and a reservoir disposed below and in fluid communication with said top face on said scoop, said reservoir being bounded by said substantially spoon shaped top face and a substantially spoon shaped bottom face, said bottom face and said top face being coupled together forming a substantially enclosed reservoir wherein said reservoir is in fluid communication with said hole on said scoop and in fluid communication with said substantially hollow handle so that when said scoop is placed inside a fluid, said fluid can be drawn through said hole, into said reservoir and through said substantially hollow handle.

2. The device as in claim 1, wherein said reservoir is shaped non cylindrical.

3. The device as in claim 1, wherein said substantially hollow handle, said scoop and said reservoir are formed as a one piece unit.

4. The device as in claim 1, wherein said scoop is coupled to said substantially hollow handle at one end and said hole is disposed on said scoop on an opposite end of said scoop.

5. The device as in claim 1, wherein said hole has a circular cross-section.

6. The device as in claim 1, wherein said hole has a non-circular cross-section.

7. The device as in claim 1, wherein said hole on said scoop is formed by a gap between said top face and said bottom face.

8. The device as in claim 1, wherein said hole on said scoop is positioned adjacent to a coupling point between said reservoir and said substantially hollow handle.

9. A spoon and straw combination device comprising:

a substantially hollow handle having at least one opening;

a scoop attached to said substantially hollow handle, said scoop having a top face shaped similar to a spoon and at least one hole; and a reservoir disposed within said scoop below said top face and in fluid communication with said top face, said reservoir being defined by said spoon shaped top face and a substantially spoon shaped bottom face, to form a substantially enclosed reservoir wherein said reservoir is in fluid communication with said at least one hole and with said substantially hollow handle.

10. The device as in claim 9, wherein said reservoir is formed by a top plate containing said top face of said scoop and a bottom plate disposed adjacent to said top plate, said bottom plate being substantially coupled to said top plate.

* * * * *